US005496152A

United States Patent [19]

Heise et al.

[11] Patent Number: 5,496,152

[45] Date of Patent: Mar. 5, 1996

[54] PUMP WITH INTERNAL VALVE BETWEEN SUCTION AND PRESSURE REGIONS

[75] Inventors: Manfred Heise, Welnbach; Hans J. Lauth, Usingen; Van D. Nguyen, Frankfurt; Erwin Stammler, Kronberg, all of Germany

[73] Assignee: Luk Farhzeug-Hydraulik GmbH & Co. KG, Bad Homburg, Germany

[21] Appl. No.: 244,158

[22] PCT Filed: Nov. 11, 1992

[86] PCT No.: PCT/EP92/02584

§ 371 Date: Sep. 30, 1994

§ 102(e) Date: Sep. 30, 1994

[87] PCT Pub. No.: WO93/10354

PCT Pub. Date: May 27, 1993

[30] Foreign Application Priority Data

Nov. 23, 1991 [DE] Germany ..... 41 38 516.0

[51] Int. Cl.[6] ..... F04B 23/08; B05B 1/00

[52] U.S. Cl. ..... 417/87; 417/189; 417/198; 239/600

[58] Field of Search ..... 417/87, 198, 159; 239/424, 600

[56] References Cited

U.S. PATENT DOCUMENTS

| | | | |
|---|---|---|---|
| 2,724,335 | 11/1955 | Eames . | |
| 2,985,357 | 5/1961 | Carolan | 417/189 |
| 3,207,077 | 9/1965 | Ziegler . | |
| 3,551,073 | 12/1970 | Petrovits | 417/87 |
| 3,614,266 | 10/1971 | Ciampa | 417/87 |
| 3,640,069 | 2/1972 | Sugahara et al. | 417/87 |
| 3,922,113 | 11/1975 | Turner . | |
| 4,517,163 | 6/1979 | Pinto et al. | 239/600 |
| 4,712,739 | 12/1987 | Bihn | 239/600 |
| 4,823,550 | 4/1989 | Decker | 417/87 |
| 5,181,414 | 1/1993 | Baret et al. | 417/87 |

FOREIGN PATENT DOCUMENTS

| | | | |
|---|---|---|---|
| 0125328 | 11/1984 | European Pat. Off. . | |
| 2074206 | 10/1971 | France . | |
| 2443598 | 7/1980 | France . | |
| 0690161 | 10/1979 | U.S.S.R. | 239/600 |
| 2266342 | 10/1993 | United Kingdom | 417/198 |

*Primary Examiner*—Richard A. Bertsch
*Assistant Examiner*—Ted Kim
*Attorney, Agent, or Firm*—Herbert Dubno

[57] ABSTRACT

A pump in which a valve bridges the pressure region and the suction region and the delivery system displaces liquid from the suction region to a pressure region. The pump housing has an annular channel connected to the suction or intake passage and into which an injector extends to train a jet from the high pressure side a the valve into the suction region through the channel which surrounds the injector so that the jet asperates liquid from the channel into the suction region.

2 Claims, 3 Drawing Sheets

PUMP WITH INTERNAL VALVE BETWEEN SUCTION AND PRESSURE REGIONS

CROSS REFERENCE TO RELATED APPLICATION

This is a national phase of PCT/EP 92/02584 filed 13 Oct. 1992 and based, in turn, on German national application P41 38 516.0 of 23 Nov. 1991.

The invention relates to a pump which comprises a delivery system in a pump hosing, a fluid supply channel extending in the pump housing, and a control valve between suction and pressure regions of the pump. An injector actuatable by fluid under high pressure transports fluid from the supply channel or passage to the suction region of the delivery system.

BACKGROUND OF THE INVENTION

Pumps of the aforedescribed type are used for instance in power-assisted steering systems and feed a special fluid, e.g. an oil, for assistance of the steering forces exerted on the steering wheel of a motor vehicle. Preferably these pumps are vane pumps, which suck oil from a supply outside the pump, such as a reservoir. Such pumps are equipped with a valve, i.e. a flow control valve, through which the oil can be directed from the, high pressure region to the suction region of the pump. Starting from a certain rotational speed of the pump and at firmly established flow rates the valve opens an escape bore, wherein the oil under high pressure can escape. The bypassed oil reaches the intake space of the delivery system. Frequently the pump is not completely filled with the hydraulic oil. Moreover the channels through which the oil flows can be damaged due to cavitation.

OBJECT OF THE INVENTION

From U.S. Pat. No. 2,724,335 a pump for delivering a fluid is known wherein an injector is actuatable by fluid under high pressure and through this injector fluid is delivered from the supply channel to the suction region of the delivery system. It is a disadvantage that the injector, particularly during pressure fluctuations of the fluid, can not always insure that a sufficient quantity of fluid can be delivered to the suction region of the delivery system.

Furthermore arrangement of injectors are known also from printed applications FR-A-2 074 206 and FR-A-2 443 598, wherein by means of a fluid exiting a reservoir under high pressure a further fluid can be delivered to the suction area of delivery system. Here too it is disadvantageous that in case of pressure fluctuations an insufficient amount of fluid is directed towards the suction area.

Therefore with the known injector arrangements it is practically impossible to insure a cavitation-free operation in presence of variable flow rates of the delivery system.

OBJECT OF THE INVENTION

It is therefore the object of the invention to enable a cavitation-free operation of the pump for the entire range of rotational speeds, whereby a sufficient filling of the pump with hydraulic oil is insured.

SUMMARY OF THE INVENTION

This object is attained in a pump of the type described, but wherein the body of the injector is surrounded by an annular channel which is connected with the supply channel.

By means of the injector which is actuated by a fluid coming from an area under high pressure and feeds oil from the supply channel to the suction region of the delivery system, a sufficient filling of the suction region is insured for all stages of the opeation. Therefore based on the good supply of the suction region with hydraulic oil cavitation damage can be avoided.

A preferred embodiment of the pump has an inlet zone of the injector located close to the outlet of the control valve, which optionally allows a fluid under high pressure to empty into an escape bore. The energy-rich fluid is captured by the injector, so that damage inside the pump housing is avoided. Based on the fact that the opening of the injector into the supply channel is arranged immediately ahead of the suction region of the delivery system, an optimal guidance of the oncoming fluid is insured, so that even at a high flow rate of the pump cavitation can be avoided.

The basic body of the injector can be surrounded by an annular channel which is connected to the supply channel. Oil coming from an oil supply located outside the pump, for instance a reservoir, is guided through the annular channel around the injector, so that a particularly good suction effect is insured, whereby the jet exiting the injector is optimally used with respect to its entire circumferential or peripheral surface.

The basic body of the injector can be a substantially tubular sleeve. Its inlet opening is assigned to a fluid exiting a control valve, its outlet opening is assigned to the suction chamber of the delivery system. The ooil exiting the valve, as well as the fluid entrained from the supply channel are guided in a predetermined direction, namely towards the suction region of the delivery system. This insures a good filling of the suction region so that cavitation can be avoided.

According to the invention the width a of the annular channel, the diameter b of the channel segment, and the diameter c of the discharge bore are in porportions of a:b:c:=3.7:2.3:1 and/or for a free length d of the jet traversing the injector, the partial length e of the injector and the height f of the annular channel are in the proportions d:e:f=1.6:0.85:1 with a value c=1 selected arbitrarily. A safety element in the form of a fastening sleeve is kprovided which is supported on one side in the housing of the pump and on the other side on the injector.

The fastening sleeve can have an anchoring ring which can be anchored in the housing of the pump and from which extend holding webs which rest against the injector, preferably against the collar. The fastening sleeve can have two holding webs extending from the anchoring ring. The holding webs are arranged so that the fluid aspired by the pump can flow unobstructed into the inner space of the fastening sleeve.

Due to the fact that the basic body of the injector is surrounded by an annular channel which is connected with the supply channel, an optimal feeding of the fluid is insured, so that even at changing flow rates of the pump cavitation is avoided. Oil coming from an oil supply provided outside the pump, for instance a reservoir, is guided around the injector through the annular channel, so that an especially good suction effect is insured, whereby the jet exiting the injector is optimally utilized over its entire circumferential, respectively peripheral surface.

Further an embodiment of the pump is preferred, wherein the a safety element designed like a fastening sleeve is assigned to the injector. The safety element is thereby supported on one side on the basic pump body and on the other side on the injector. By assigning the fastening sleeve it can be insured that the injector can be mounted in a sufficiently secure manner in the basic pump body, particularly in the case of pumps with small overall dimensions. This way the operation safety of the injector in smaller pumps is increased, because in spite of the reduced available fastening surface the injector can be securely kept in its mounted position under all conditions of operation.

Further embodiments of the pump result from the remaining dependent claims.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
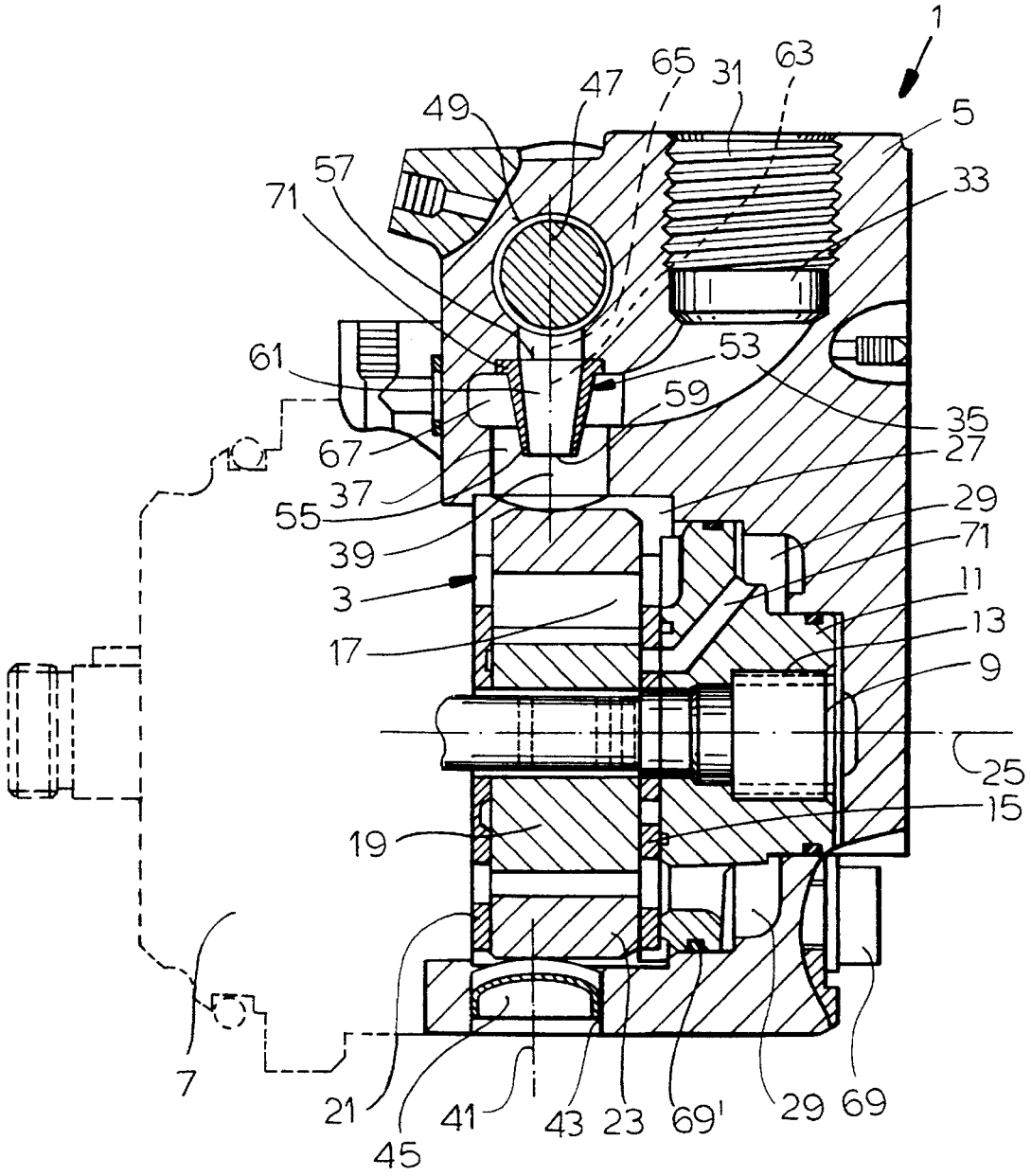
FIG. 1 is a schematic longitudinal section through a first embodiment of a pump according to the invention.

In the following it is presumed that the pump 1 shown in the drawing has as a delivery system 3 a vane cell arrangement, which is located inside the housing 5 of the pump.

The pump 1 can be provided with a bearing flange 7 of any configuration. It is therefore indicated here only in dotted lines.

The drive shaft 9 which in the illustration runs horizontally transverses the bearing flange 7 and is held there by suitable supports. With its right end arranged inside the pump housing 5 it can be rotatably supported in a pressure plate support 11. The latter is pressed by means of a compression spring 13, braced between the pressure plate support 11 and the housing 5. The spring urges the support 11 against a pressure plate 15. This in turn rests against the rotor 19 having vane 17. The vanes are supported so as to be radially displaceable in corresponding slots in the rotor 19.

On the left side of the rotor 19 corotationally connected with driving shaft 9 there is a side plate 21, which is supported on its side facing away from the rotor on the bearing flange 7.

With their ends which are outside the rotor 19, the vanes 17 rest against a ring 23, so that between the individual vanes enclosed spaces are formed. Considered over the ring circumference, the inner surface of ring 23 has different distances from the axis of rotation 25 of pump 1, so that the enclosed spaces formed between the vanes 17 become larger and smaller during one rotation of the rotor, so that the fluid from a suction chamber 27 of the pump 1 is pushed into a pressure chamber 29. Thereby the fluid passes through the pressure plate 15. By means of compression spring 13, the pressure plate support 11 and thereby the pressure plate 15 are pushed against the ring 23, and in turn the latter is pushed against the side plate 21.

The fluid moved by the pump 1 is supplied from an external storage container, for instance a reservoir, which is connected to a suction connection 31 provided in the upper side of housing 5. The suction connection 31 forms a part of a supply channel 33, through which the oil reaches the suction chamber 27.

The supply channel 33 has a segment 35 shaped like an arc of a circle, which leads to a channel segment 37 opening directly into the suction chamber 27.

The median axis 39 of the channel segment 37 is aligned with the median axis 41 of a bore 43 traversing the wall of housing 5. This means that the channel segment 37 can be produced by a making a bore in the housing 5. The bore 43 is closed in a pressure-tight manner by lid 45.

Perpendicular to the axis of the drawing a flow control valve 47 is arranged, which in the direction of its longitudinal axis, i.e. perpendicular to the plane of the drawing, can be displaced within a valve bore 49. The displacement takes place depending on the prevailing pressure in the pressure chamber 29 against the force of a compression spring not shown here. The valve bore 49 is also connected with the pressure chamber 29 through suitable channels in the pump housing. The function of such a flow control valve is known, so that it is not necessary to elaborate any further thereon.

The position of the valve changes depending on the pressure and the rotational speed of the pump. Starting from a certain selectable flow rate at a certain rotational speed, the check valve opens so that a fluid jet under high pressure can enter an escape bore 51. This is selected to be very short and end directly in an injector 53, which has an elongated, substantially tubular basic body 55. The latter is preferably made of an erosion-resistant material. The cross section through the basic body shows that the thickness of its walling decreases from the inlet opening 57 to the outlet opening 59, whereby on the one hand the outer surface of the basic body can have the shape of a frustrum of a cone, while the flow zone 61 traversing the inside of the injector 53 is shaped approximately cylindrically or also like the frustrum of a cone i.e. tapers in the direction of flow.

The median axis 61 of the injector 53 coincides here with the median axis 39 of the channel segment 37 and also with the median axis 65 of the escape bore 51.

The injector 53 is surrounded by an annular channel 67, which is connected with the bent segment 35 of the supply channel 33 and with the channel segment 37.

The housing 5 of pump 1 is fastened in an appropriate manner to the bearing flange 7. Here for instance a screw 69 for the connection of both parts is indicated. The inside of the housing 5 is shaped so that the pressure plate support 11 is slidable in the direction of the axis of rotation 25. Between that and the housing 5 a circular gasket 69' is provided, for the separation of the suction chamber 27 from the pressure chamber 29. Preferably the pressure chamber 29 is also circular. A bore 71 traverses the pressure plate support 11, also traverses the pressure plate 15 and ends at rotor 19 in the region of the foot of vane 17. Thus pressure is applied to the vane for the radially outward motion thereof.

From the sectional view it can be seen that the supply channel 33 can be brought directly up to the escaped jet entering the escape bore 51. The escaped jet is captured by the injector 53, respectively by its basic body 55, 53 or by its body, so that an erosion of the housing 5 of pump 1 can be safely avoided. At the same time the fluid jet traversing the injector is accelerated, especially by a narrowing of the outlet opening 59 in comparison to the inlet opening 57, so that oil under low pressure is very well entrained. By the annular channel 57 the fluid in the supply channel is brought close to the entire peripheral area of the jet leaving the injector 53, so that its effect is particularly enhanced. A large amount of the fluid in the annular channel is thus entrained by the jet leaving the injector 53, so that a very good filling of the suction chamber 27 is insured. Therefore cavitation is avoided even at a high suction rate of the delivery system.

In the illustration the median axis 65 of the escape bore 51, the median axis 63 of injector 53, as well as the median axis 39 of the channel segment 37 are in one line. But it is also possible to swing the median axis of injector 53 with respect to the other two axes, so that the outlet opening 59 of the injector does not point directly downwards, but for instance to the right. The injector thus permits a guidance not only of the fluid originating from the valve bore 49 but also of the entrained oil, so that the suction chamber of the pump is optimally filled with fluid to be delivered also with a different arrangement of the individual parts.

The injector 53 illustrated here is characterized by a collar 55' surrounding its inlet opening 57, which leads to a reinforcement of the injector and makes it possible to press this part into the housing wall. For other types of mounting the collar 55' can be designed even bigger than has been shown in FIG. 2.

In view of the fact that the median axis 41 of bore 43 and the median axis 39 of the channel segment 37 are aligned, both areas can be drilled in a single operation in the material of the housing 5. The annular channel 67 running concentrically to the channel segment 37 is preferably cast in the basic body of the housing 5. Furthermore through the bore 43 an annular recess in the basic body of the housing 5 can be made, which can then serve to receive the collar 55'. The outer diameter of the collar 55' is smaller than the inner diameter of bore 43, but also than the one of the channel segment 37. The injector can then be inserted into the housing from the outside through the bore 43 and through the channel segment 37. Automation of the introduction of the injector into the housing 5 of pump 1 is also possible.

The escape bore 51 is also made with the help of a drill which is guided through the bore 43 and run thereby through the channel segment 37. Therefore it can be seen that the mounting of the injector 53 in the housing 5 is very simple, whereby it is also simple and cost-efficient to build in the fluid-guiding channels cooperating with the injector, i.e. the escape bore 51, the channel segment 37 and the annular channel 67.

At his turn the injector 53 can also be produced inexpensively, since its basic body 55 can be made as a substantially tubular sleeve. The space requirement of the injector is extremely low, so that the pump can have a compact construction.

In the end it is irrelevant for the operation of the injector 53 that the flow control valve is perpendicular to the axis of rotation 25 of the driving shaft 9, as shown in the sectional view. Essential is that the escaped jet be captured by injector 53 as close as possible to the control valve 47 and that in the immediate vicinity of this area a suction of the fluid to be delivered take place through the annular channel 67.

The annular channel insures a good utilization of the fluid jet traversing the injector, since it completely surrounds the basic body 55. The diameter of the annular channel and of the outlet opening 59 of the injector 53 can be adjusted according to the viscosity of the used fluid, the flow rate and the flow velocity of the fluid leaving the injector. An optimal filling of the suction chamber 27 can thus be insured for a cavitation-free operation of the pump at the different flow rates.

In the embodiment illustrated here the width of the annular channel 67 surrounding the basic body 55 of the injector 53 is so coordinated with the length of the injector 53 that an optimal aspiration of the fluid under low pressure results. The effective length of the injector equals approximately one and a half times the height of the annular channel. In order to insure a turbulence—free incoming flow from the supply channel 33 and the curved channel 35 into the annular channel 67, the diameter of the curved area 35 is selected so that this area ends in an opening with a diameter which corresponds with the height of the annular channel. The outer diameter of the annular channel 67 is selected to be somewhat larger than the diameter of the channel segment 37. Due to these dimensions of the annular channel a particularly good flow around the peripheral surface of the injector 53 is achieved, so that the suction effect of the jet leaving the injector 53 is put to very good use.

Furthermore the sectional view also shows that losses can be kept low when the escaped jet enters the injector 53 by selecting the inner diameter of the escape bore 51 to be equal to the diameter of the inlet opening 57.

Figure 2:
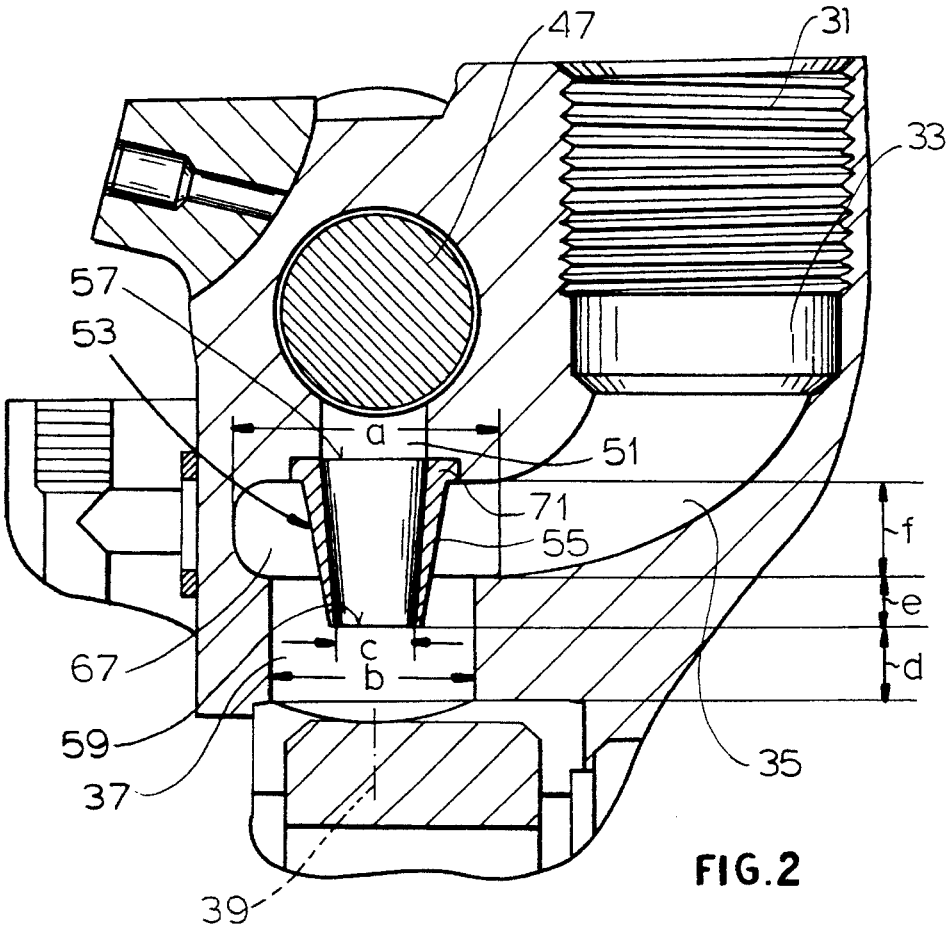
FIG. 2 is an enlarged longitudinal section through the injector shown in FIG. 1.

With the aid of FIG. 2 which shows an enlarged longitudinal section through the injector 53 the size proportions in the area of the injector are more precisely illustrated.

The width a of the annular channel 67, the diameter b of the channel segment 37 the diameter c of the outlet opening 59, the free stretch e which is left within the channel segment 37 for the jet leaving the injector 53, the length portion of the injector 53 inside the channel segment 37 and the height or width f of the annular channel 67 are all shown.

From the facts stated above results The basic condition for the operation of the injector is met only then when a sufficiently large flow volume can be aspired from the outside, which means from the storage container. Only this can prevent cavitation in the pump. Therefore the jet coming from the injector fluid must aspirate liquid from the reservoir which is not shown here via the suction connection 31, the supply channel 33, its curved area 35 and the annular channel 67.

During the operation of a pump with civitation, the cavitation manifests itself at first only in a decrease of the flow rate, finally with increasing suction problems the operating noises of the pump become increasingly louder.

The injector has to be calculated so that even a small decrease of the flow rate is prevented. Basically the injector is calculated for a flow rate ranging between 14 to 28 $cm^3$/rotation. Therefore changes in the dimensions of the injector and in its surrounding areas are particularly critical. In the embodiment shown here the size of diameter b of the channel segment 37 and for the diameter c of the outlet opening 59, as well as for the free length d and of the length portion e should be altered only slightly, preferably within the range of 1/10 mm, in order to insure an optimal operation of the injectors. The following calculation of an injector—where starting out with the dimensions c=1—has proven itself in practice:

a:b:c=3.7:2.3:1 d:e:f=1.6:0.86:1.1

Figure 3:
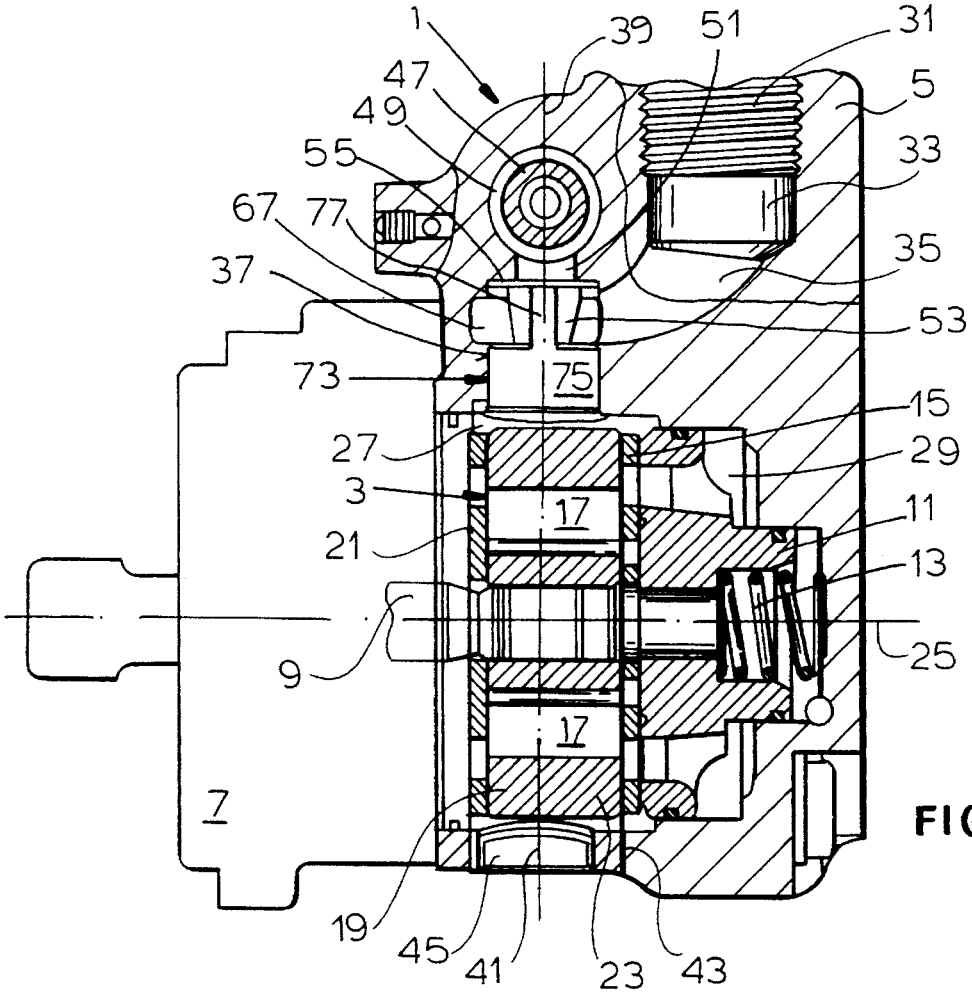
FIG. 3 a schematic longitudinal section through a further embodiment of a pump.

The embodiment illustrated in FIG. 3 differs from the one shown in FIG. 1 merely in that the injector 53 is held in the housing 5 of pump 1 by a fastening sleeve 73 serving as a safety element. In the here selected illustration parts which coincide with the ones in FIG. 1 and 2 are marked with the same reference numerals. so that here it can be dispensed with their detailed description.

The fastening sleeve 73 has an anchoring ring 75 arranged in the channel segment 37, whose outer diameter is so fitted to the inner diameter of the channel segment 37 that the fastening sleeve is securely kept in place at all temperatures which can occur during the use of pump 1. The height of the anchoring ring is selected so that practically it can not intrude upon the annular channel 67 arranged upstream, so that the medium delivered by the pump can flow through without problems. Also on the opposite side the anchoring ring 75 practically does not project into the suction space 27, so that here too the medium aspired by the pump is not hindered.

The anchoring ring 75 is provided with at least one, preferably two diametrally opposed holding webs which extend upwards through the annular channel 67, up to the collar 71 of injector 53. The holding webs 77 press against the lower side of collar 71, this way holding the injector 53 in its mounted position. Especially when the pump 1 has small overall dimensions, the collar 71 finds only little support in the basic body 5 of pump 1, so that a high degree of operational safety is achieved due to the use of fastening sleeve 73. The injector 53 is securely kept in its desired mounted position through the entire temperature range in which the pump 1 operates.

Thereby it is possible to hold the fastening sleeve 73 in the channel segment by press fitting. It is also conceivable to achieve a positive locking between the fastening sleeve and the basic pump body by means of a ribbing on the inner surface of the channel segment and an appropriate ribbing on the outer surface of the fastening sleeve. Finally it is also conceivable to provide the channel segment with a threading on its inner surface which meshes with an outer threading on the outside of the anchoring ring. This means that the fastening sleeve 73 can be screwed into the basic pump body and this way can securely hold the injector in its initial position.

It is very clear that medium flowing from the suction connection 31 into the annular space 67 is practically unobstructed by the holding webs 77; furthermore it can flow freely through the inner space of the fastening sleeve, i.e. through the inside of the anchoring ring 75 it can reach the suction space 27, whereby the medium exiting under high pressure the outlet opening 59 of the injector 53 (see FIG. 4) entrains the medium present in channel segment 37, respectively inside the anchoring ring 75, so that the suction space 27 is optimally filled.

The fastening sleeve 73 is preferably arranged so that the fluid passing from the curved area 35 into the annular channel 67 is not obstructed by the holding webs 77. This means that there are no holding webs 77 in the area of the opening between the curved area 35 and the annular channel 67.

Figure 4:
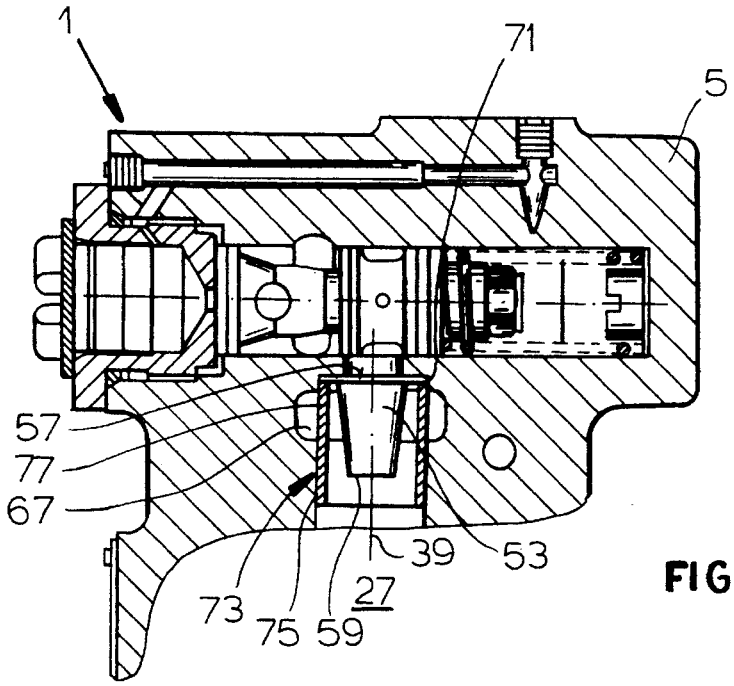
FIG. 4 is a section which is perpendicular to the section plane through the injector of the pump illustrated in FIG. 3.

The arrangement of the fastening sleeve 73 results again clearly from the sectional view in FIG. 4, whose section plane is perpendicular to the section plane selected in FIG. 3. Parts which correspond to the ones described in FIGS. 1 to 3 have here the same reference numerals. so that it can be dispensed with their In the illustration of FIG. 4 large parts of the pump 1 which have no bearing on the clarification of the mounting position of fastening sleeve 73, have been eliminated.

Figure 5:
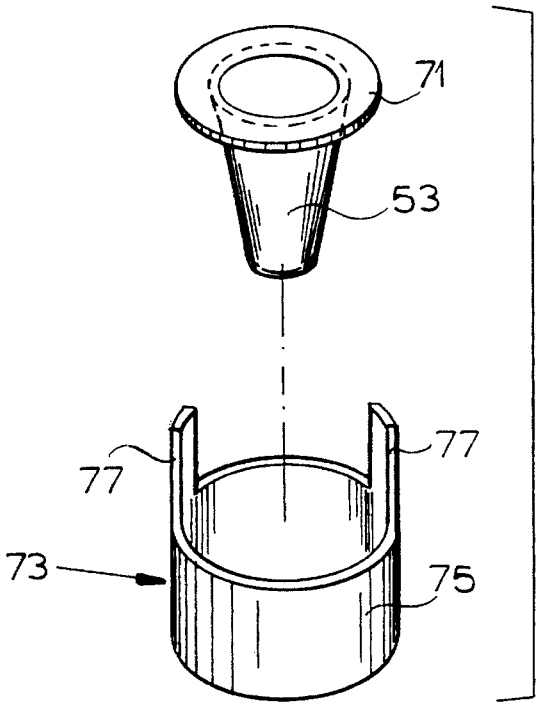
FIG. 5 is an exploded view of the injector and fastening sleeve assembly.

FIGS. 4 and 5 shows particularly clearly that the fastening sleeve 73 is hollow on the inside. The inner diameter of the fastening sleeve is selected so that medium delivered by the pump can pass unobstructed from the annular channel 67 into the suction space 27. The outlet opening of the injector 53 is located approximately at half height of the anchoring ring 75. The dimensions of the injector and the fastening sleeve 73 can be selected as established with the aid of FIG. 2. Thereby the reference value b is set for the inner diameter of the anchoring ring 75, respectively of the fastening sleeve 73.

FIGS. 4 and 5 shows again clearly that the holding webs 77 of fastening sleeve 73, starting from the anchoring ring 75, extend through the annular channel 67 and end at the lower side of the collar 71 of injector 53. Thus in the firmly mounted state of the fastening sleeve 73 in the basic body 5 of pump 1 they can keep the injector securely in its mounted position. A secure fastening of the injector 53 inside pump 1 is thereby insured at all temperatures occurring during the operation of the pump. Particularly in a pump 1 with small overall dimensions, a reduced height of collar 71 and therewith a low holding force of the injector inside the housing 5 results. As can be seen from the explanations to FIGS. 3 and 4, this holding force is substantially increased due to the holding sleeve 73, especially when besides a normal press fit of the fastening sleeve 73 inside the housing 5 also a positive locking between sleeve and housing is selected.

The width of the holding webs 77 can be relatively small, since they have a high stability due to the curvature of the sleeve. The fastening sleeve 73 is built in its entirety as a hollow body, whose inner and outer surfaces have the shape of a circular cylinder. Therefore the holding webs 77 themselves are so curved that they safely absorb the forces acting in vertical direction, i.e. the forces acting in the direction of the median axis 39, which is also the median axis of the fastening sleeve 73.

Altogether it is evident that due to the fastening sleeve made mainly of metal, which can be manufactured in a simple manner, a high operational safety of the pump is achieved, since the injector is kept in its mounted position even when the dimensions are small. Thereby the manufacturing costs of the pump are practically not increased, since the sleeve, just like the injector 3, can be introduced without further ado through the bore 43 in the inside of the housing 5 of pump 1 and anchored in the area of the channel segment 37.

Since the fastening sleeve 73 serves exclusively for securing the injector 53, it can not be allowed to obstruct the medium delivered by the pump. Preferably the inner diameter of the sleeve is selected so that the medium is optimally guided towards the outlet opening 59 of injector 53 and this way is entrained by the medium exiting the injector at high speed. In the area of the annular channel 67 the medium has to be as little as possible obstructed. This can be achieved also by designing the fastening sleeve in the area of the annular channel like a perforated plate. Preferably also narrow holding webs 77 are selected, as can be seen clearly particularly from FIG. 3, in order to achieve a particularly low flow resistance.

In principle it is also possible to incline somewhat the holding webs 77 in the direction of the injector 53 and to have them rest against its outer surface, so that the latter is securely kept in its mounted position. Thereby it is necessary to coordinate the inner diameter left free by the holding webs with the outer diameter of the injector in the area where the holding webs engage on the outer surface of the injector. The production of the fastening sleeve 73 is most cost-efficient when the holding webs 77 are a quasi continuation of the walling of the anchoring ring 75 and extend parallel to the median axis of the sleeve, respectively of the injector up to its collar 71, holding it securely in the basic body 5 of pump 1.

We claim:

1. A pump, comprising:

a housing formed with an inlet at a suction region and an outlet at a pressure region;

a delivery system in said housing for displacing a liquid from said suction region to said pressure region, said housing being formed with a fluid supply passage communicating with said suction region;

a control valve connected between said suction region and said pressure region;

an injector receiving said liquid under high pressure from said valve for discharging a jet of said liquid;

means in said housing forming an annular channel connected to said passage and surrounding said injector, whereby said jet entrains liquid from said channel into said suction region, said housing being further formed with a bore aligned with said injector; and a sleeve fastening said injector in said housing forming an insert received in said bore, said sleeve having an anchoring ring anchored in said bore of said housing and two webs provided on said ring and extending inwardly from said ring into engagement with a collar of said injector, said webs being arranged so as not to interfere with aspiration of liquid by said jet into and through said sleeve.

2. The pump defined in claim 1 wherein said annular channel has a width a, said injector has an outlet opening into a bore with a diameter b, said outlet opening has a diameter c, said outlet opening is spaced inwardly of an end of said bore by a distance d, the injector penetrates into said bore by a distance e, said annular channel has a height f, and $$a:b:c=3.7:2.3:1 \text{ and}$$

$$d:e:f=1.6:0.85:1.$$

* * * * *